US011077576B1

(12) United States Patent
Talbott

(10) Patent No.: US 11,077,576 B1
(45) Date of Patent: Aug. 3, 2021

(54) TILE CUTTING DEVICE

(71) Applicant: Harry Eugene Talbott, Powell, OH (US)

(72) Inventor: Harry Eugene Talbott, Powell, OH (US)

( * ) Notice: Subject to any disclaimer, the term of this patent is extended or adjusted under 35 U.S.C. 154(b) by 0 days.

(21) Appl. No.: 16/141,958

(22) Filed: Sep. 25, 2018

Related U.S. Application Data

(60) Provisional application No. 62/563,102, filed on Sep. 26, 2017.

(51) Int. Cl.

| | |
|---|---|
| ***B26D 7/10*** | (2006.01) |
| ***B26D 1/15*** | (2006.01) |
| ***B26D 7/01*** | (2006.01) |
| ***B26D 7/22*** | (2006.01) |

(52) U.S. Cl.
CPC ..... *B26D 7/10* (2013.01); *B26D 1/151* (2013.01); *B26D 7/015* (2013.01); *B26D 7/22* (2013.01)

(58) Field of Classification Search
CPC ..... B26D 1/151; B26D 7/10; B26D 7/015; B26D 7/22
USPC .. 83/15–16, 170, 425.2, 425.3, 425.4, 508.3
See application file for complete search history.

(56) References Cited

U.S. PATENT DOCUMENTS 977,829 A * 12/1910 Ourdan ..... C03B 33/10 33/32.1
1,570,318 A * 1/1926 Pollard ..... B24B 27/06 125/13.01
1,833,470 A * 11/1931 Olson ..... B27B 5/063 83/421
2,293,178 A * 8/1942 Stocker ..... B26D 1/225 83/16
2,467,728 A * 4/1949 Burt ..... B23D 47/045 83/113
2,551,811 A * 5/1951 Mueller ..... B29C 67/00 83/170
2,622,680 A * 12/1952 Yakubik ..... B29C 65/20 83/15
2,925,864 A * 2/1960 Rueggeberg ..... B29B 13/023 83/16
2,976,658 A * 3/1961 Kostur ..... B65B 11/52 53/509
3,191,522 A * 6/1965 Drake ..... B27M 3/0053 100/303
3,274,876 A * 9/1966 Debus ..... B23D 47/04 83/415
3,280,677 A * 10/1966 Grzymislawski ..... C03B 33/10 83/881
3,772,537 A * 11/1973 Clifford ..... E06B 9/24 310/309
3,942,781 A * 3/1976 Gerber ..... B23Q 1/032 269/289 R (Continued)

*Primary Examiner* — Ghassem Alie
(74) *Attorney, Agent, or Firm* — Robert R. Lech; Lech Law, LLC

(57) ABSTRACT

Vinyl tile cutting devices are disclosed herein. The disclosed vinyl tile cutting devices include a base element. The base element is configured to support a vinyl tile thereon. The disclosed vinyl tile cutting devices further include a cutting assembly. The cutting assembly includes one or more rotatable cutting blades for cutting said vinyl tile in a generally linear manner. In some embodiments, the vinyl tile cutting device includes a heating element. The heating element is configured to heat said tile prior to the cutting of said vinyl tile.

13 Claims, 13 Drawing Sheets

(56) References Cited

U.S. PATENT DOCUMENTS 4,098,155 A * 7/1978 Insolio ..... C03B 33/027 83/485
4,279,280 A * 7/1981 Pairis ..... B27G 13/005 144/218
4,320,678 A * 3/1982 Volk ..... B23D 49/162 269/87.2
4,401,001 A * 8/1983 Gerber ..... B26D 1/185 83/451
4,735,531 A * 4/1988 Boerckel ..... B23Q 1/621 144/136.95
5,003,729 A * 4/1991 Sherby ..... B23Q 11/0032 451/365
5,188,013 A * 2/1993 Cardinale ..... B26D 1/045 33/527
5,443,881 A * 8/1995 Higgins ..... B32B 7/12 428/93
5,566,599 A * 10/1996 Ebihara ..... B26D 1/151 83/158
5,907,984 A * 6/1999 Herman, Jr. ..... B26D 1/185 83/100
5,996,459 A * 12/1999 Cornell ..... B26D 1/185 83/485
6,073,621 A * 6/2000 Cetrangolo ..... B23D 45/027 125/12
6,118,101 A * 9/2000 Choboter ..... E04F 15/105 219/395
6,119,676 A * 9/2000 Greenland ..... B28D 1/047 125/35
6,427,677 B1 * 8/2002 O'Banion ..... B23D 45/02 125/13.01
6,439,218 B1 * 8/2002 Hulett ..... B27B 27/02 125/11.22
6,460,443 B1 * 10/2002 Hsiao ..... B23D 35/008 83/455
6,463,970 B1 * 10/2002 Bradshaw ..... B27B 5/34 144/218
6,508,244 B2 * 1/2003 Lee ..... B23D 47/025 125/12
6,752,139 B2 * 6/2004 Lee ..... B23D 47/025 125/12
6,838,147 B2 * 1/2005 Burns, Jr. ..... D06N 7/0086 428/313.3
7,347,132 B2 * 3/2008 Schultz ..... B23D 35/008 83/485
7,373,865 B2 * 5/2008 Allen ..... B23D 47/04 269/81
7,493,704 B2 * 2/2009 Bailey ..... E04F 21/0076 33/526
7,946,906 B2 * 5/2011 Gifford ..... B23D 59/003 451/8
7,998,793 B2 * 8/2011 Sato ..... H01L 21/67092 438/113
8,677,984 B2 * 3/2014 Boyd ..... B28D 1/30 125/12
9,027,450 B1 * 5/2015 Ana ..... B23D 45/048 83/471.3
2009/0000442 A1 * 1/2009 Peterson ..... B26D 7/015 83/56
2016/0031106 A1 * 2/2016 Wu ..... B26D 3/28 83/15
2017/0312930 A1 * 11/2017 Zhang ..... B26D 5/10
2018/0283701 A1 * 10/2018 Williams ..... F24D 13/024

* cited by examiner

Detail "A"

TILE CUTTING DEVICE

CROSS-REFERENCE TO RELATED APPLICATIONS

This application claims priority to U.S. Provisional Patent Application Ser. No. 62/563,102 filed Sep. 26, 2017 entitled "Tile Cutting Device," which is incorporated by reference in its entirety as if fully set forth herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

Technical Field

The present invention generally relates to cutting devices. More particularly, the present invention relates to cutting devices for cutting tiles in a generally linear manner.

Background and Description of Related Art

Vinyl composition tile (VCT) is a widely used flooring system for both residential and commercial buildings because of its durability and cleanability. VCT is typically furnished in twelve inch by twelve inch (12"×12") squares, and is often installed in different, alternating directions. Also, different colors of tile squares are sometimes utilized in a building floor so as to avoid the monotony resulting from a floor having only a single color and pattern.

Conventional tile cutters, which are used for cutting vinyl composition tile, are generally only capable of cutting a single piece of tile at a time. Thus, when it is necessary to cut multiple pieces of tile of the same shape in a consecutive manner, a cutting guide, which is typically provided on these conventional tile cutters, is set to a particular position. Then, multiple pieces of tile are cut to the same shape while the cutting guide is left in its set position. However, even cutting a tile in half is extremely difficult with these conventional tile cutters because tiles are typically dense and brittle, making them difficult to cut properly. It is virtually impossible, and not cost effective for the tile installer, to use these conventional tile cutters for non-standard tile cutting patterns, such as cutting the tile at 90 degree, 45 degree, and 22½ degree angles.

Therefore, there is a need for a tile cutting device that is capable of cutting flooring tile with increased accuracy and ease-of-use. Moreover, there is a need for a tile cutting device that is capable of accurately cutting non-standard tile cutting patterns, such as cutting the tile at 90 degree, 45 degree, and 22½ degree angles. Furthermore, there is a need for a tile cutting device that makes the tile easier to cut through, such as by heating the tile prior to the cutting thereof.

SUMMARY OF EXAMPLE EMBODIMENTS

Accordingly, the present invention is directed to an improved tile cutting device that substantially obviates one or more problems resulting from the limitations and deficiencies of the related art.

According to a first embodiment of the present application, Applicant discloses a tile cutting device configured to cut tiles into a plurality of different shapes. The tile cutting device of the first embodiment comprises: a) a base element, said base element configured to support a tile thereon; and b) a cutting assembly, said cutting assembly including a plurality of spaced-apart rotatable cutting blades for cutting said tile in a generally linear manner. The tile cutting device is configured to accurately cut said tile at a plurality of predetermined cutting angles relative to one or more edges of said tile.

The base element of the tile cutting device of the first embodiment may comprise a cutting plate for supporting the tile thereon. The cutting plate comprises indicia for aligning the tile in a plurality of different angular positions so that the tile is capable of being cut at any of the plurality of predetermined cutting angles.

The base element of the cutting device of the first embodiment may comprise a pair of spaced-apart rails for supporting said cutting assembly.

The cutting assembly of the cutting device of the first embodiment may further include a safety cover disposed over at least a portion of the plurality of spaced-apart rotatable cutting blades so as to protect a user of the tile cutting device from being inadvertently cut by the plurality of spaced-apart rotatable cutting blades.

The base element of the cutting device of the first embodiment may further include one or more securing elements for holding the tile in place relative to the base element.

The base element of the cutting device of the first embodiment may further include a top surface and a bottom surface. The top surface of the base element is configured to support the tile thereon, and the bottom surface of the base element is supported on a plurality of support legs.

The tile cutting device of the first embodiment may further comprise a heating element, the heating element configured to heat the tile prior to the cutting of the tile.

In accordance with the tile cutting device of the first embodiment, the plurality of predetermined cutting angles relative to the one or more edges of the tile may at least include: (i) a ninety degree cutting angle, (ii) a forty-five degree cutting angle, and (iii) a twenty-two and one-half degree cutting angle.

According to a second embodiment of the present application, Applicant discloses a tile cutting device configured to cut tiles into a plurality of different shapes. The tile cutting device of the second embodiment comprises: a) a base element, the base element configured to support a tile thereon; b) a cutting assembly, the cutting assembly including one or more rotatable cutting blades for cutting the tile in a generally linear manner; and c) a heating element, the heating element configured to heat the tile prior to the cutting of the tile. The tile cutting device is configured to accurately cut the tile at a plurality of predetermined cutting angles relative to one or more edges of the tile.

The base element of the tile cutting device of the second embodiment may comprise a cutting plate for supporting the tile thereon. The cutting plate comprises indicia for aligning the tile in a plurality of different angular positions so that the tile is capable of being cut at the plurality of predetermined cutting angles.

The cutting assembly of the tile cutting device of the second embodiment may further include a safety cover disposed over at least a portion of the one or more rotatable cutting blades so as to protect a user of the tile cutting device from being inadvertently cut by the one or more rotatable cutting blades.

The base element of the tile cutting device of the second embodiment may include one or more securing mechanisms for holding the tile in place relative to the base element.

The base element of the tile cutting device of the second embodiment may include a top surface and a bottom surface. The top surface of the base element is configured to support the tile thereon, and the bottom surface of the base element is supported on a plurality of support legs.

In accordance with the tile cutting device of the second embodiment, the plurality of predetermined cutting angles relative to the one or more edges of the tile may at least include: (i) a ninety degree cutting angle, (ii) a forty-five degree cutting angle, and (iii) a twenty-two and one-half degree cutting angle.

According to a third embodiment of the present application, Applicant discloses a tile cutting device configured to cut tiles into a plurality of different shapes. The tile cutting device of the third embodiment comprises: a) a base element, the base element configured to support a tile thereon; b) a cutting assembly, the cutting assembly including a plurality of spaced-apart rotatable cutting blades for cutting the tile in a generally linear manner; and c) a heating element, the heating element configured to heat the tile prior to the cutting of the tile. The tile cutting device is configured to accurately cut the tile at a plurality of predetermined cutting angles relative to one or more edges of the tile.

The base element of the tile cutting device of the third embodiment may comprise a cutting plate for supporting the tile thereon. The cutting plate comprises indicia for aligning the tile in a plurality of different angular positions so that the tile is capable of being cut at the plurality of predetermined cutting angles.

The cutting assembly of the tile cutting device of the third embodiment may further include a safety cover disposed over at least a portion of the one or more rotatable cutting blades so as to protect a user of the tile cutting device from being inadvertently cut by the one or more rotatable cutting blades.

The base element of the tile cutting device of the third embodiment may include one or more securing elements for holding the tile in place relative to the base element.

The base element of the tile cutting device of the third embodiment may include a top surface and a bottom surface. The top surface of the base element is configured to support the tile thereon, and the bottom surface of the base element is supported on a plurality of support legs.

In accordance with the tile cutting device of the third embodiment, the plurality of predetermined cutting angles relative to the one or more edges of the tile may at least include: (i) a ninety degree cutting angle, (ii) a forty-five degree cutting angle, and (iii) a twenty-two and one-half degree cutting angle.

BRIEF DESCRIPTION OF THE DRAWINGS

The invention will now be described, by way of example, with reference to the accompanying drawings, which are incorporated in and constitute a part of the specification, in which.

DRAWING REFERENCE NUMERALS

Figure 1:
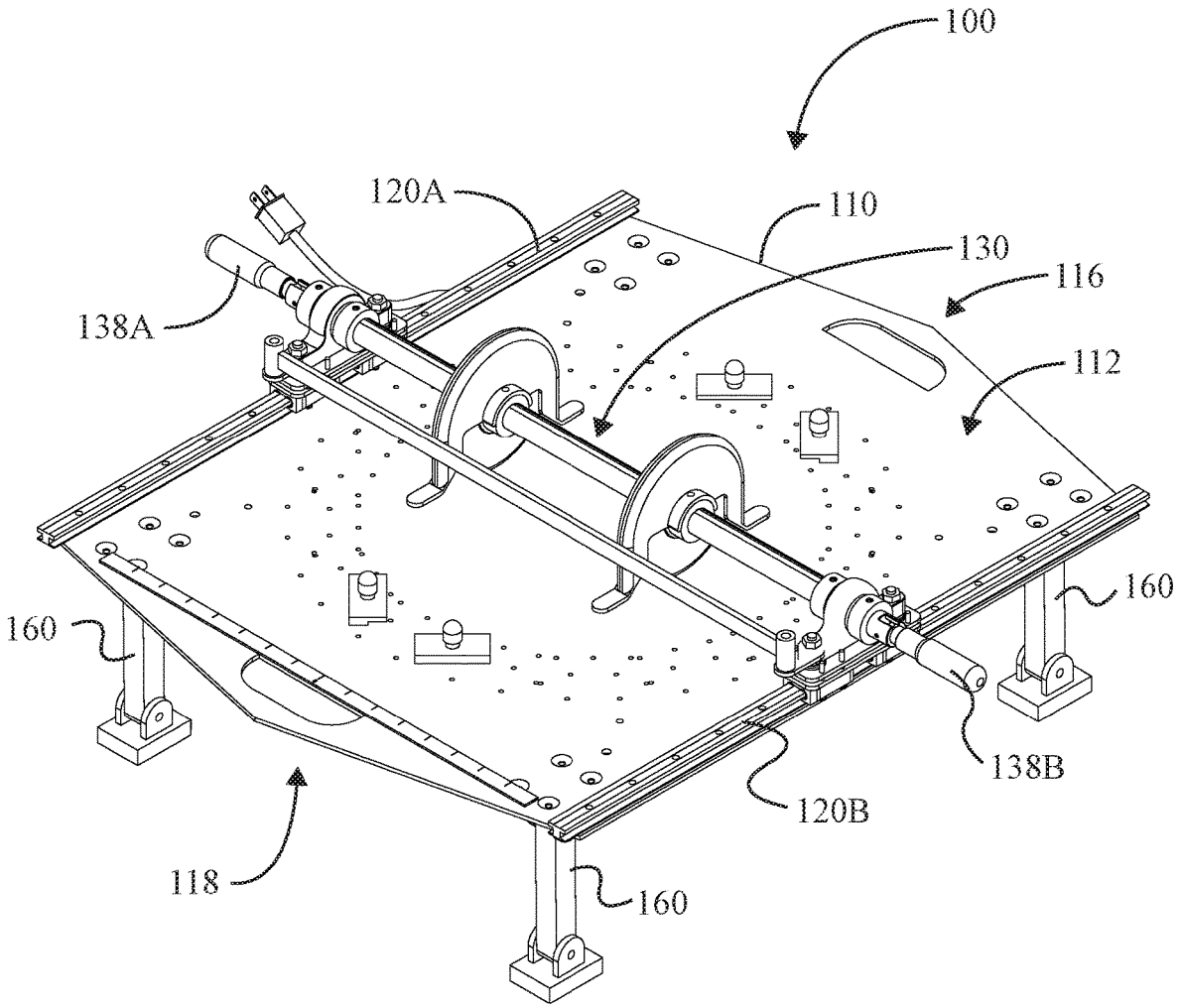
FIG. 1 is an orthographic top view of a first example tile cutting device.

The following reference characters identify the associated elements depicted in the drawings describing the present invention:

| | | | |
|---|---|---|---|
| 100 | Tile Cutting Device | 110 | Base Element |
| 102 | Tile | 112 | Top Surface |
| 114 | Bottom Surface | 140A | Left Rail Guide |
| 116 | Rear Handle | 140B | Right Rail Guide |
| 118 | Front Handle | 142 | Guard Support |
| 120A | Left Rail | 150 | Securing Element |
| 120B | Right Rail | 160 | Support Leg |
| 122 | Ruler | 170 | Heating Element |
| 130 | Cutting Assembly | 900 | User |
| 132 | Axial Support | 1700 | Hot Tile Mover |
| 134 | Blade | 1702 | Handle |
| 136 | Guard | 1704 | Frame |
| 138A | Left Handle | 1706 | Suction Cup |
| 138B | Right Handle | | |

DETAILED DESCRIPTION

To address the deficiencies of the prior art, the present application discloses an improved tile cutting device. The tile cutting device of the present application embodies several improvements over the prior art. According to one aspect of the present application, the disclosed tile cutter may comprise a heating element for heating a tile during cutting to make cutting the tile easier. According to another aspect of the present application, the disclosed tile cutter may comprise a plurality of spaced-apart rotatable cutting blades for cutting the tile in a generally linear manner.

Figure 2:
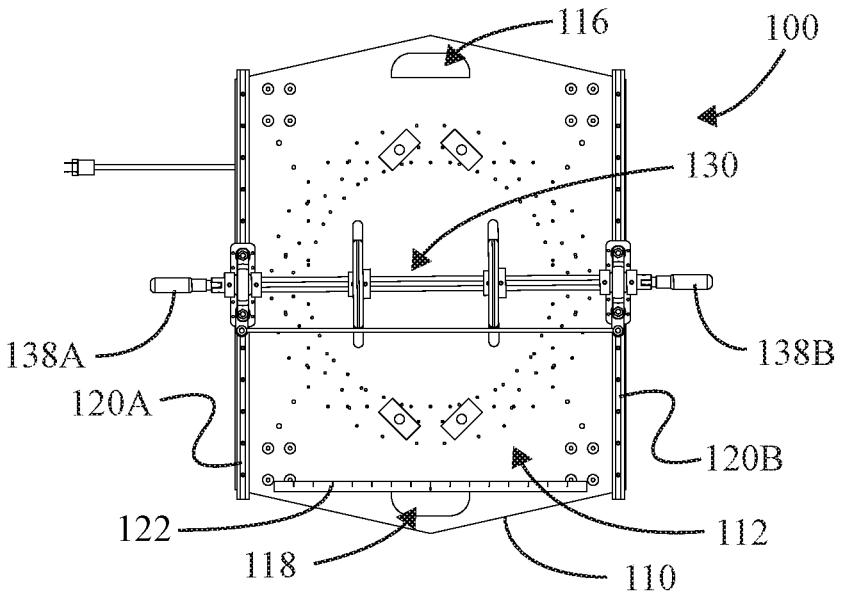
FIG. 2 is a top plan view of the first example tile cutting device.

Referring now to FIGS. 1 and 2, there is shown an orthographic view of an example tile cutting device 100. Example tile cutting device 100 comprises a base element 110 having an upper surface 112 for supporting a tile to be cut. As illustrated, base element 110 may form one or more handles, such as for example front handle 118 and rear handle 116, for moving, adjusting and/or carrying device 100.

Example tile cutting device 100 further comprises a cutting assembly 130 for performing the cutting operation. Cutting assembly 130 is supported by and movable along two rails, left rail 120A and right rail 120B. Cutting assembly 130 includes a left handle 138A and a right handle 138B which may be grasped by a user to move the cutting assembly to and fro along rails 120A and 120B. In the illustrative embodiment, the handles 138A and 138B pivot between the operative positions of FIG. 1 and the stowed positions of FIG. 14. A ruler 122 is disposed along the front of the upper cutting surface 112. Base element 110 and cutting assembly 130 are supported by a plurality of support legs 160. In the example tile cutting device 100, each of the support legs 160 is collapsible so as to make the tile cutting device 100 more compact for transporting the cutting device 100 (see FIG. 14).

Figure 3:
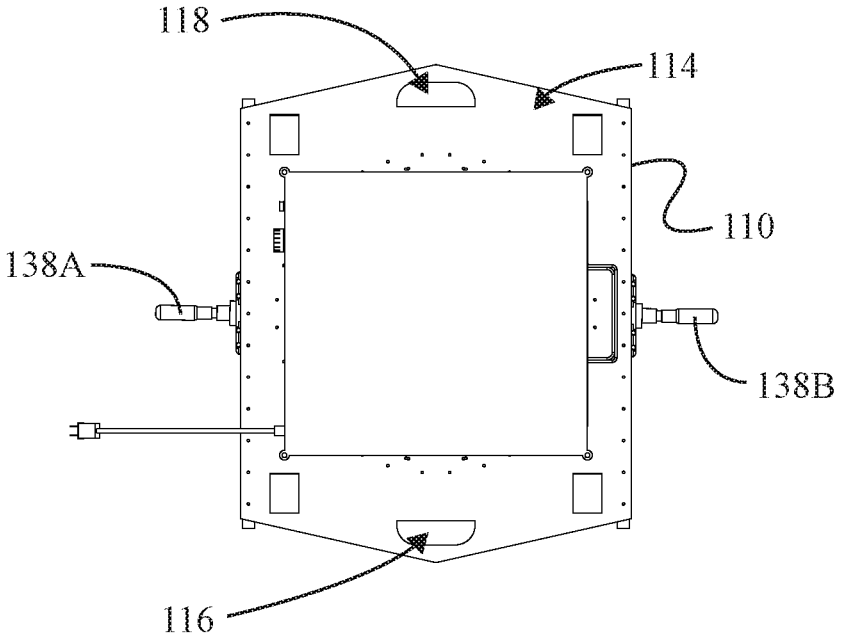
FIG. 3 is a bottom plan view of the first example tile cutting device.
Figure 4:
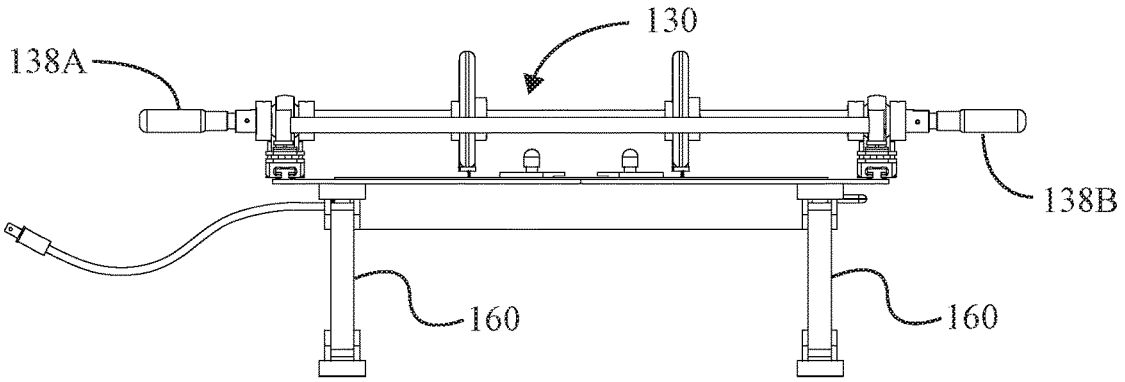
FIG. 4 is a front side view of the first example tile cutting device.
Figure 5:
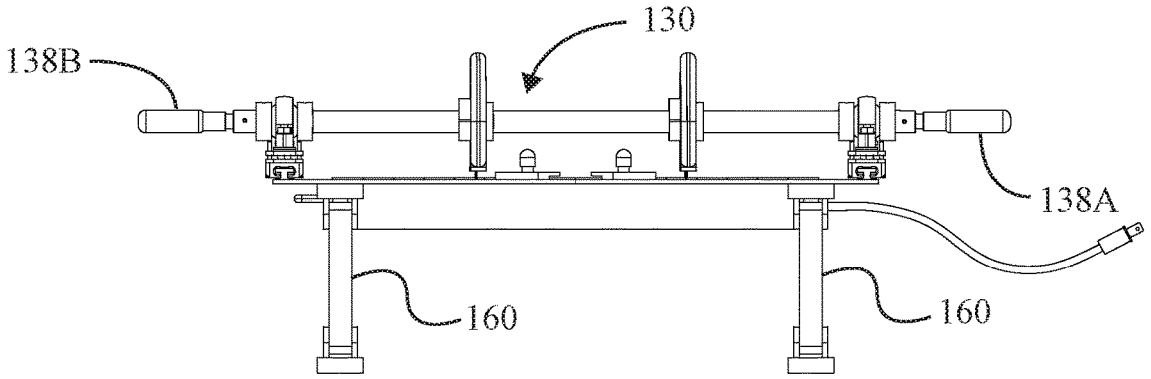
FIG. 5 is a rear side view of the first example tile cutting device.
Figure 6:
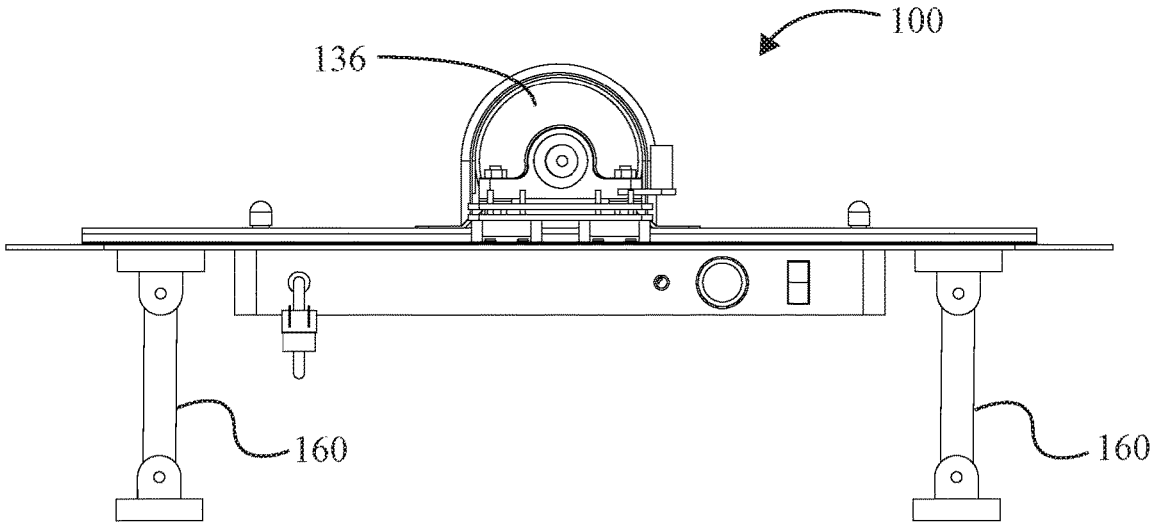
FIG. 6 is a left side view of the first example tile cutting device.
Figure 7:
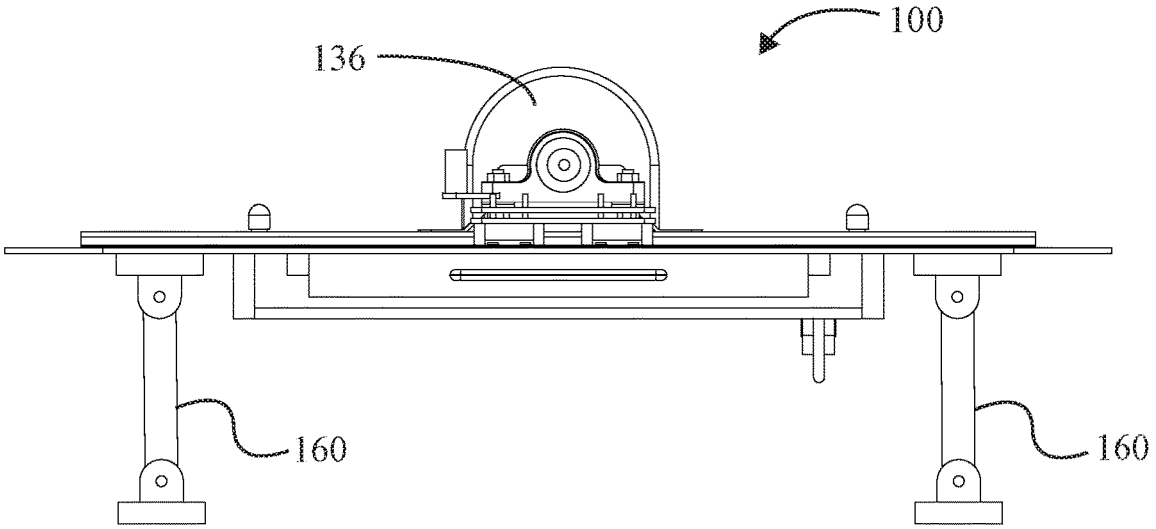
FIG. 7 is a right side view of the first example tile cutting device.

FIG. 3 depicts a bottom plan view of example cutting device 100. The bottom plan view illustrates a bottom surface 114 of base element 110 and a heating element 170 which is disposed beneath the base element 110 when cutting device 100 is properly oriented. Placement of heating element 170 beneath, and in close proximity to the bottom surface 114 of base element 110 enables heating element 170 to heat base element 110 which conducts the heat to the tile being cut. The front, rear, left and right views of FIGS. 4-7, respectively, also illustrate the relationship between heating element 170 and base element 110. As shown in the side view of FIG. 6, the illustrative heating element 170 comprises a temperature dial and a power switch proximate to one end thereof.

Figure 8:
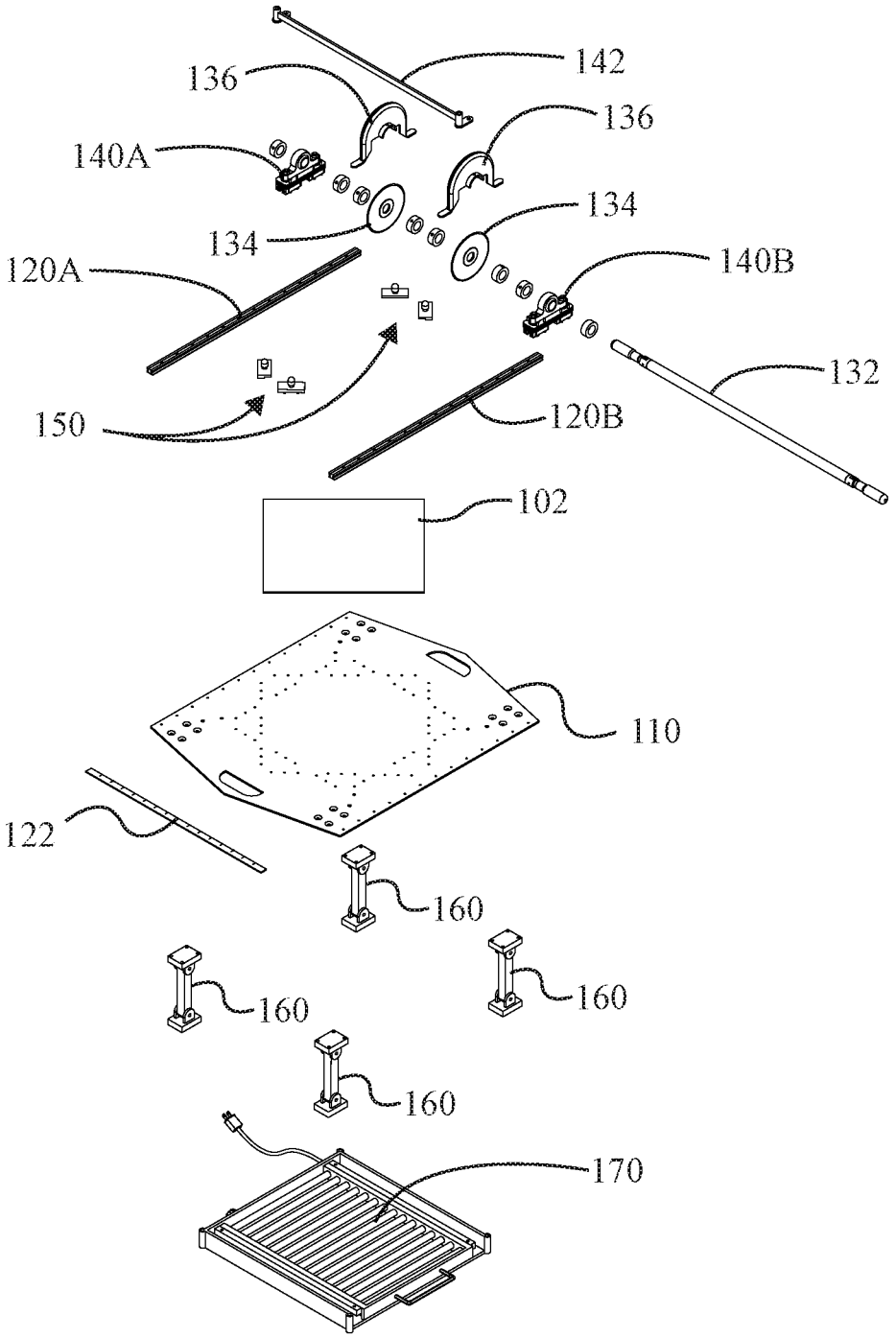
FIG. 8 is a 3D exploded view of the first example tile cutting device.

FIG. 8 depicts a 3D exploded view of the example tile cutting device 100. As illustrated, the example tile cutting device 100 comprises base element 110, rails 120A and 120B, and cutting assembly 130. Cutting assembly 130 includes axial support 132, left and right rail guides 140A and 140B, respectively, rotatable cutting blades 134, guard support 142 and guards 136. In operation, cutting blades 134 are adjustable along axial support 132. A user may employ ruler 122 to position each cutting blade 134 as desired. Cutting blades 134 are not required to be positioned symmetrically with respect to the center of ruler 122.

FIG. 8 further depicts support legs 160 and heating element 170. Finally, there is illustrated a tile 102 and a plurality of securing elements 150 for securing the tile 102 to the cutting device 100.

Figure 9:
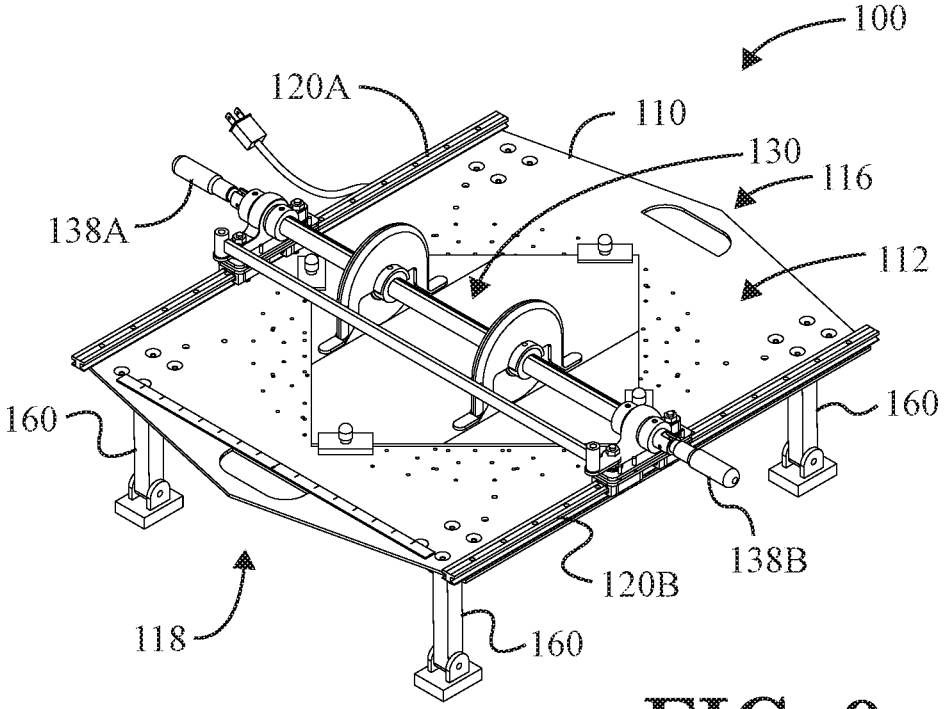
FIG. 9 is an orthographic view of the tile cutting device of FIG. 1 configured to cut a tile at a 45 degree angle.
Figure 10:
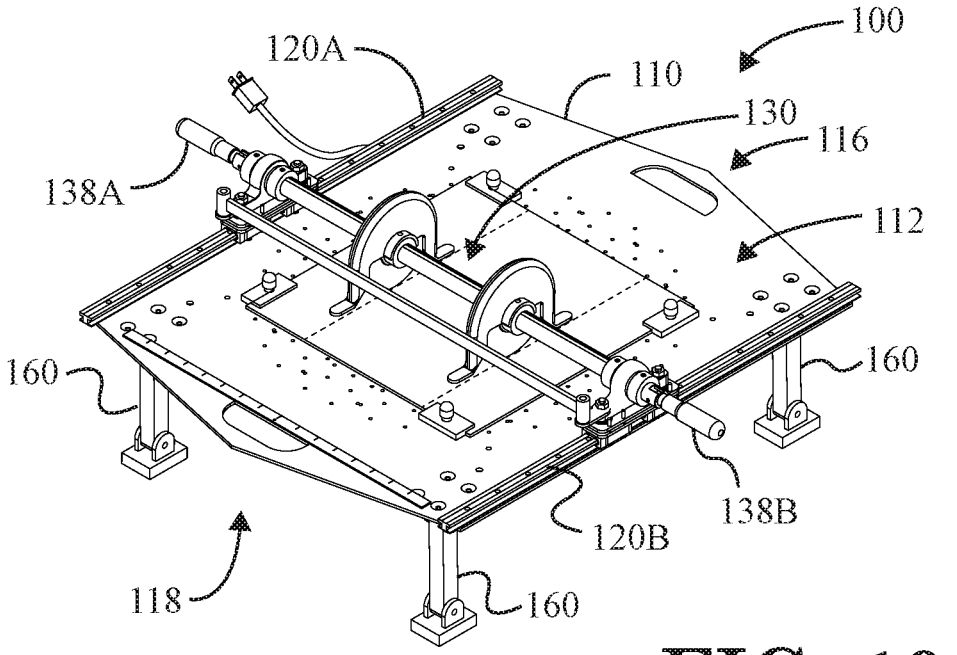
FIG. 10 is an orthographic view of the tile cutting device of FIG. 1 configured to cut a tile at a 90 degree angle.
Figure 11:
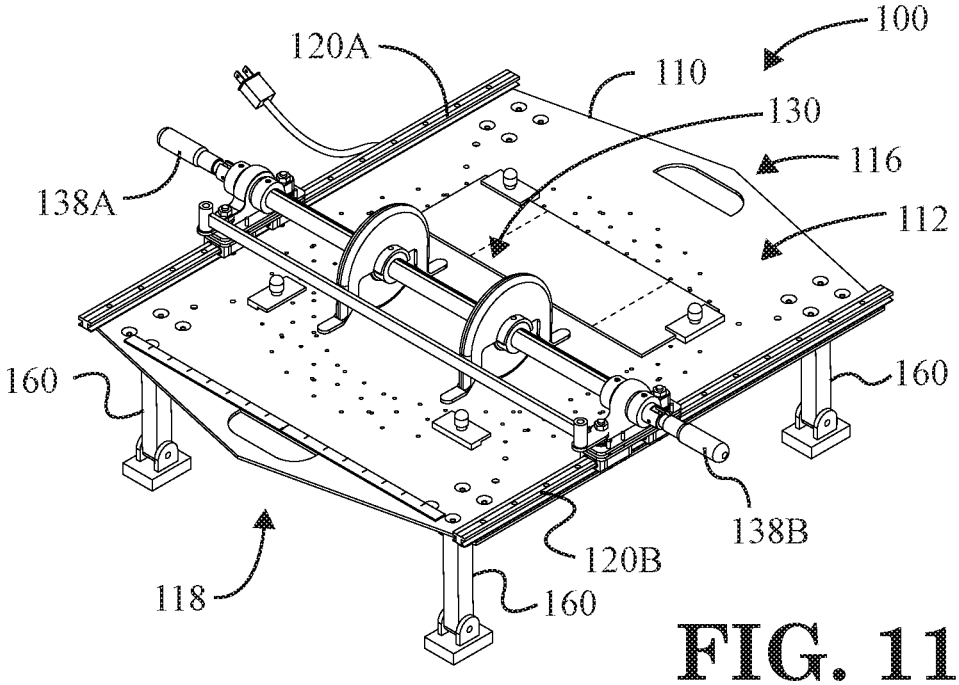
FIG. 11 is an orthographic view of the tile cutting device of FIG. 1 configured to cut a tile portion at a 90 degree angle.
Figure 12:
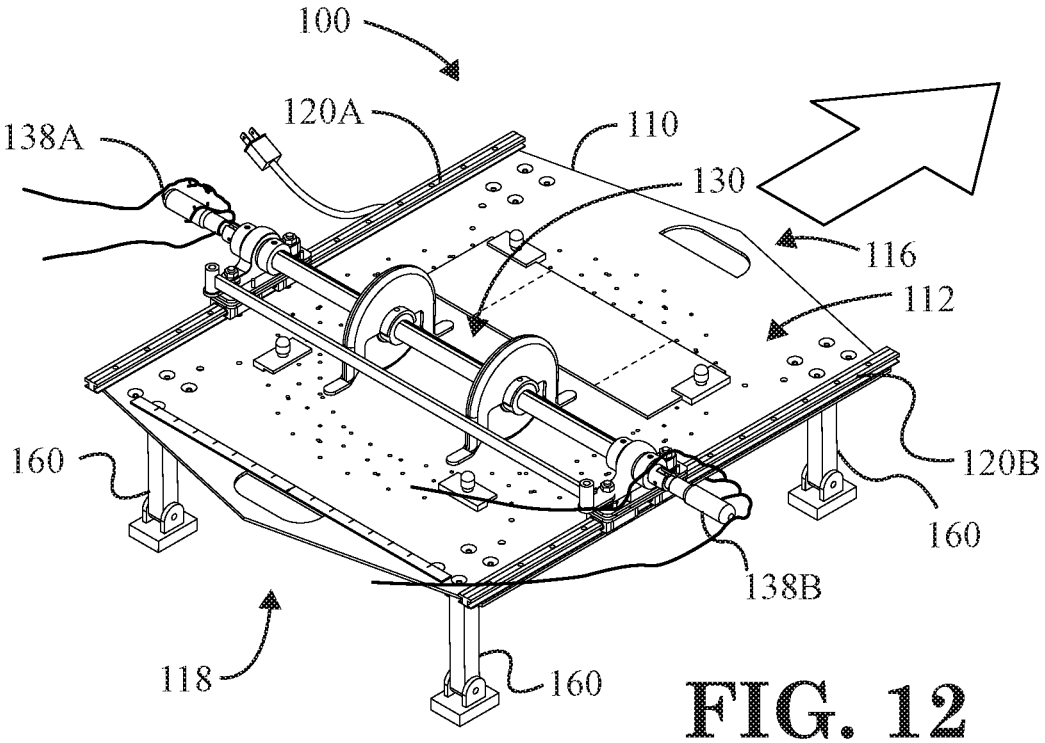
FIG. 12 is an orthographic view of the tile cutting device of FIG. 1 illustrating the user force required to cut a tile portion at a 90 degree angle.

FIG. 9 is an orthographic view of the example tile cutting device configured to cut a tile at a 45 degree angle. FIG. 10 is an orthographic view of the example tile cutting device configured to cut a tile at a 90 degree angle. FIG. 11 is an orthographic view of the example tile cutting device configured to cut a tile portion at a 90 degree angle. FIG. 12 is an orthographic view of the example tile cutting device illustrating a force required by a user to cut a tile portion at a 90 degree angle.

Figure 13A:
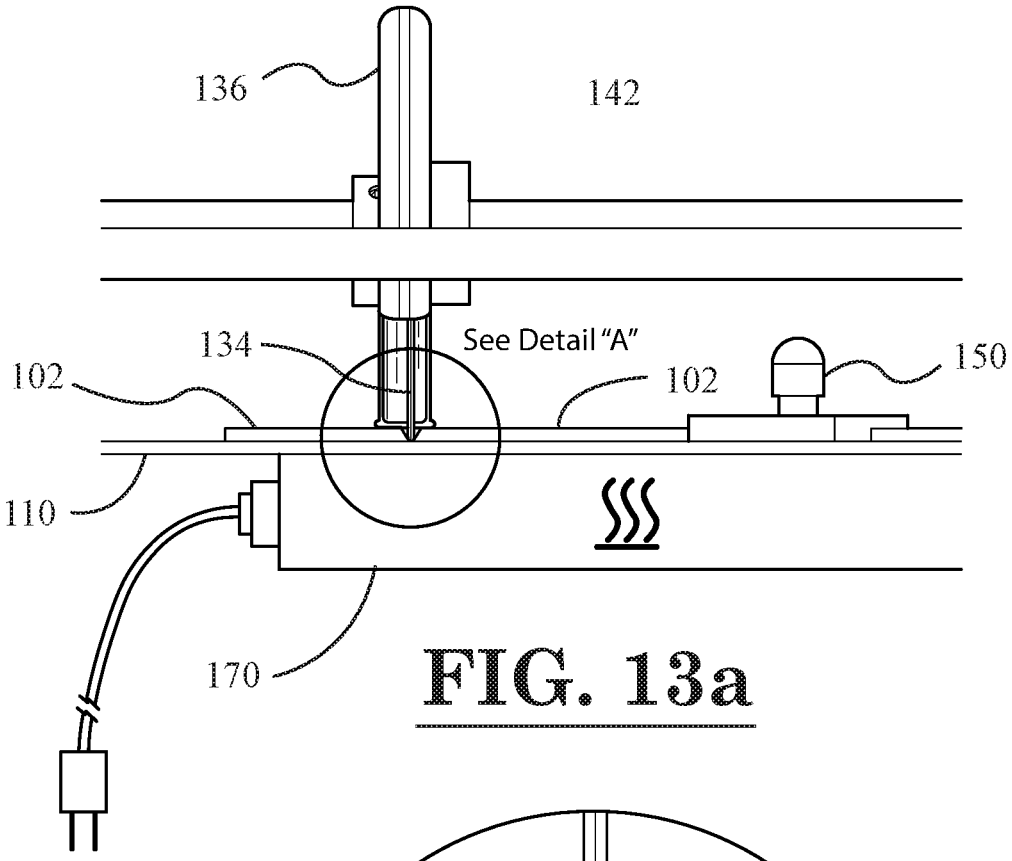
FIGS. 13*a* and 13*b* are magnified and detail front views of a portion of the cutting device during operation.
Figure 13B:
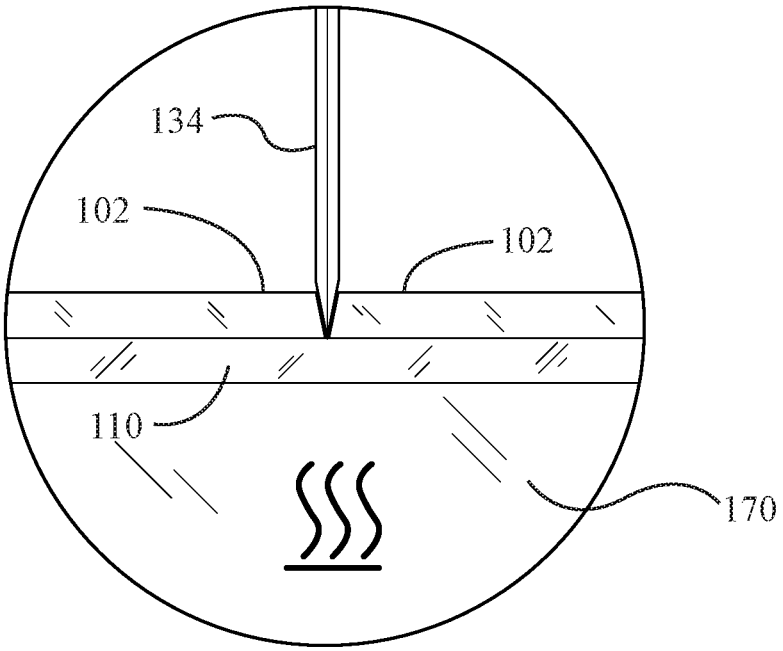

FIGS. 13*a* and 13*b* are magnified and detail front views of a portion of the cutting device during operation.

FIG. 13*a* is magnified front view of a portion of the cutting device during operation. Specifically, FIG. 13*a* illustrates a tile 102 secured to base element 110 using securing element 150. One of the blades 134 is shown cutting tile 102. The blade 134 is suspended from axial support 132. Blade 134 is covered by guard 136 which is suspended from guard support 142. Guard support 142 additionally adds rigidity to the cutting assembly 130 so as to stabilize the cutting assembly 130 and prevent the cutting assembly 130 from jamming during the displacement of the blades 134 by a user. Heating element 170 is illustrated as radiating heat directly to base element 110 which, in turn, applies heat to tile 102 during the cutting operation. The cutting operation is even more clearly shown in FIG. 13*b*.

Figure 14:
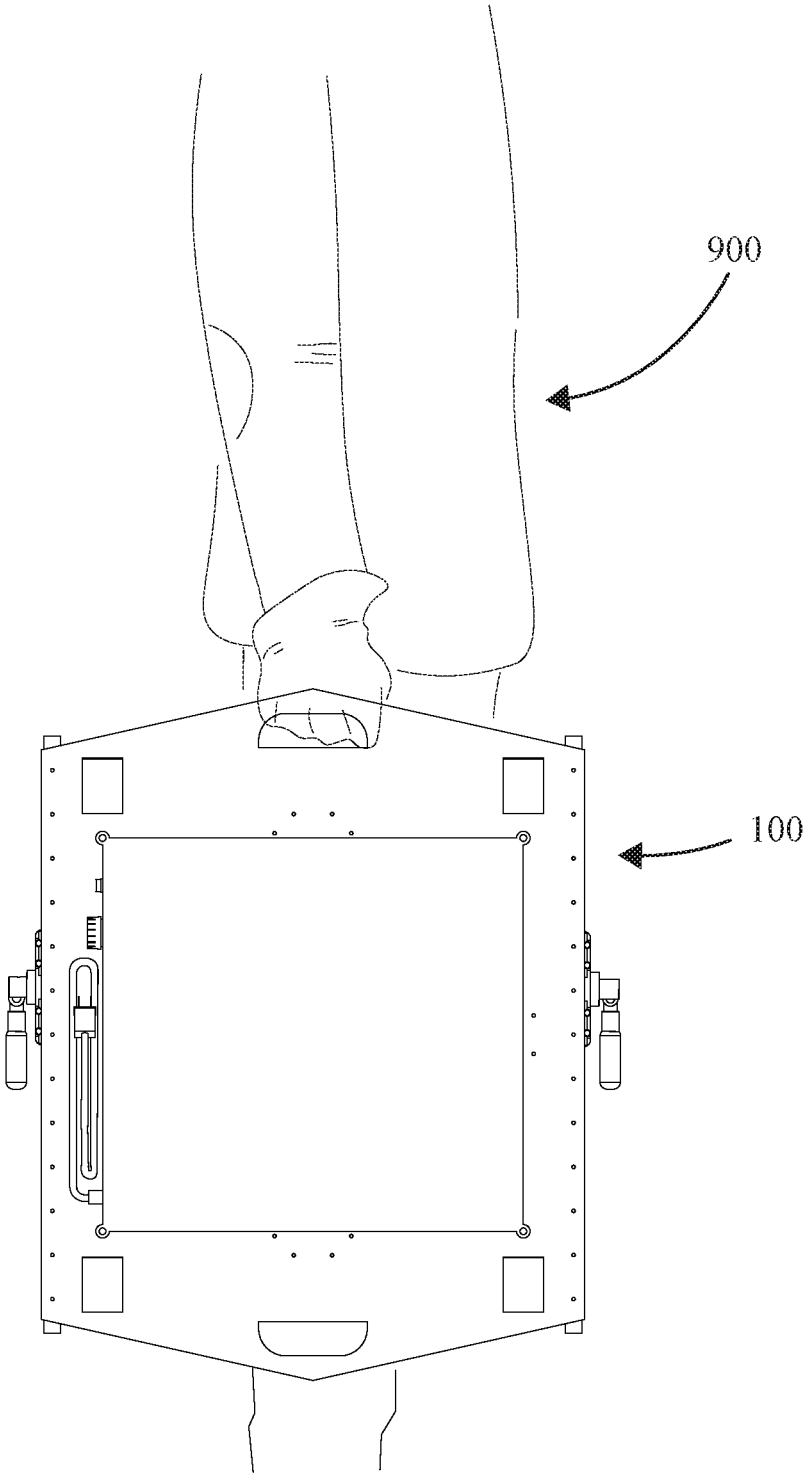
FIG. 14 is an orthographic view of the tile cutting device of FIG. 1 being transported by a user.

FIG. 14 is an orthographic view of tile cutting device being transported by a user 900. In FIG. 14, the handles 138A and 138B of the cutting assembly 130 been folded into their stowed positions to make the tile cutting device 100 more compact for transportation by the user 900.

Figure 15:
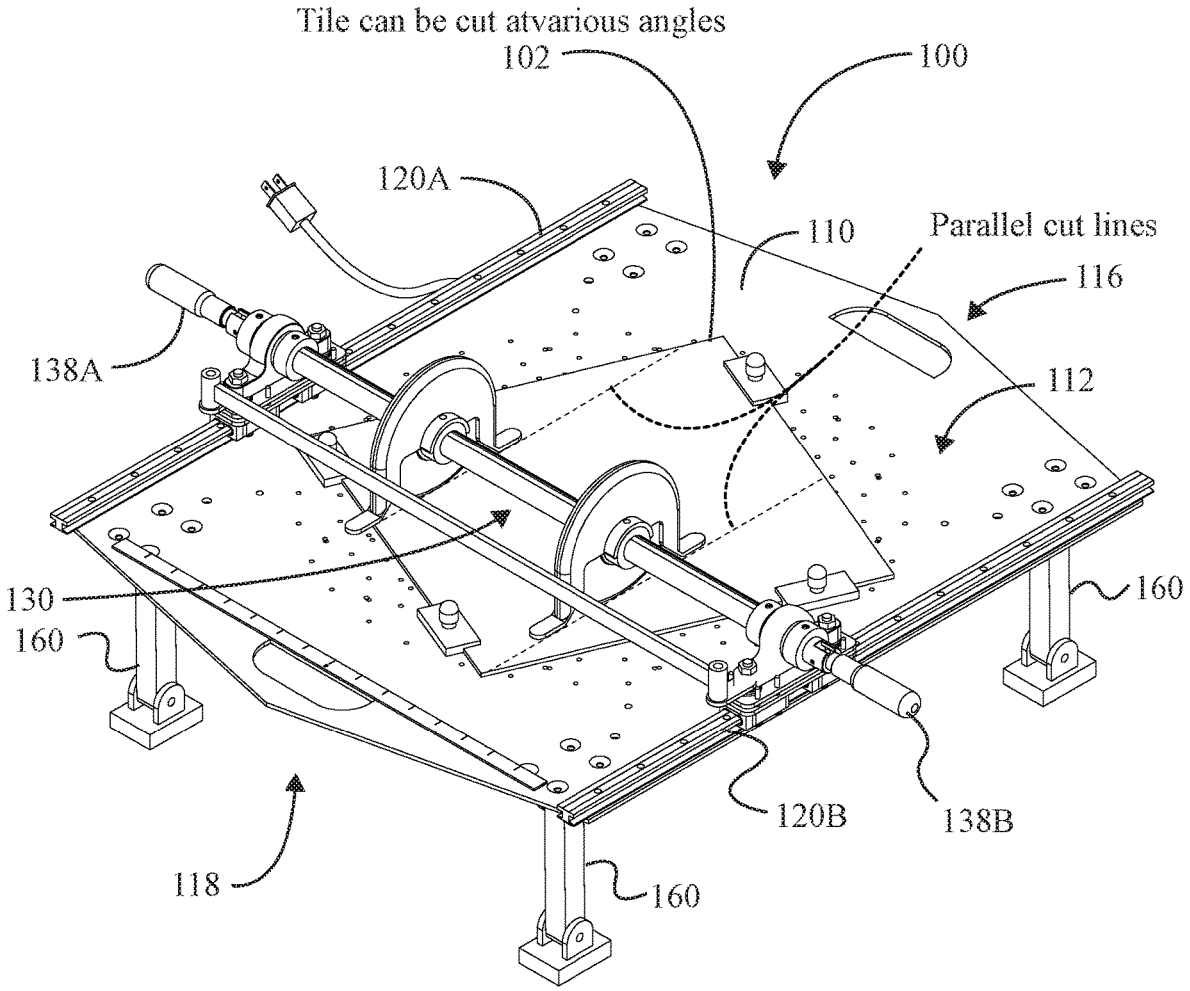
FIG. 15 is an orthographic view of the tile cutting device of FIG. 1 configured to cut a tile at a 22.5 degree angle.

FIG. 15 is an orthographic view of the example tile cutting device configured to cut a tile at a 22.5 degree angle.

Figure 16:
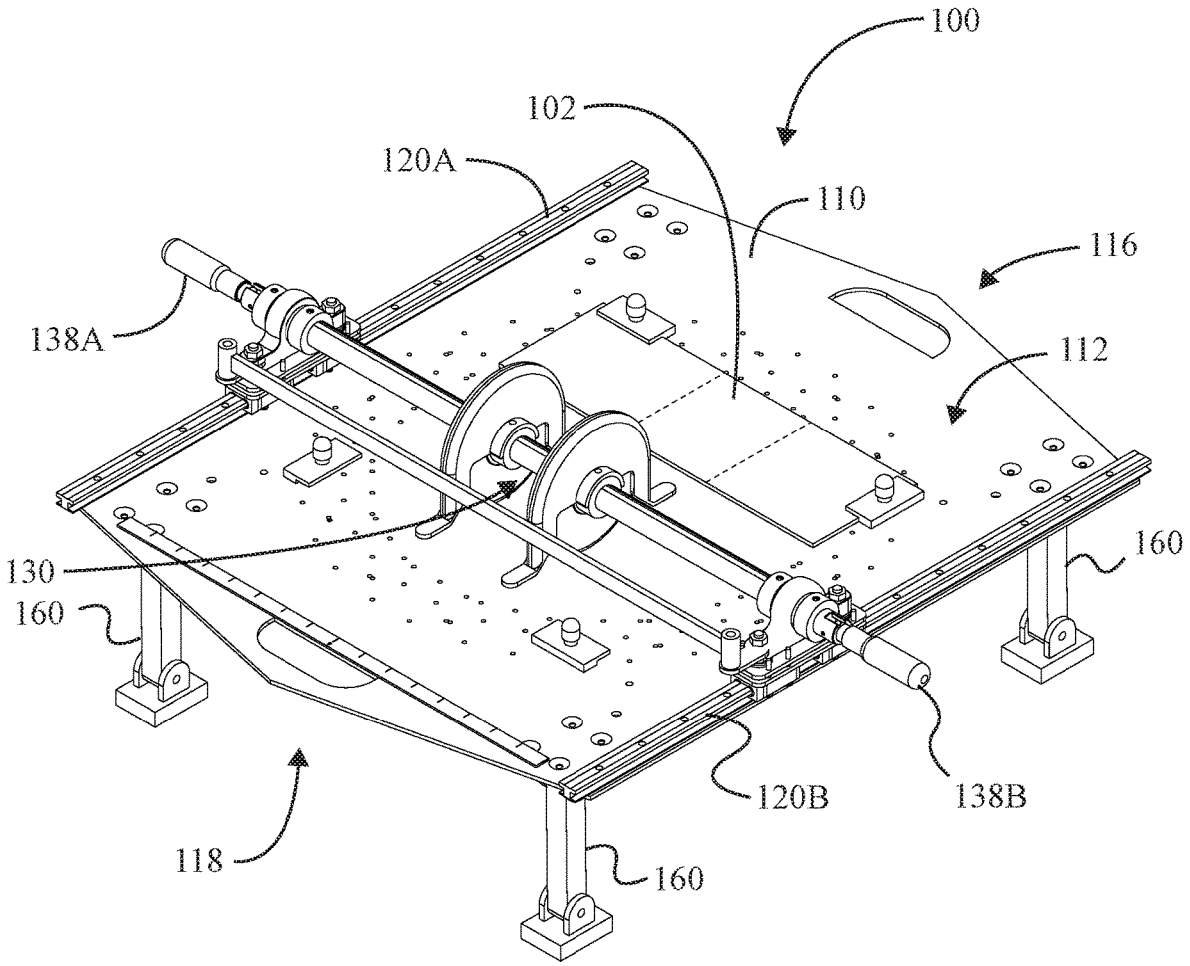
FIG. 16 is an orthographic view of the tile cutting device of FIG. 1 configured to cut a tile portion at a 90 degree angle.

FIG. 16 is an orthographic view of the example tile cutting device configured to cut a tile portion at a 90 degree angle. Note that the cutting blades 134 are positioned closer to the center than those shown in FIG. 12.

Figure 17:
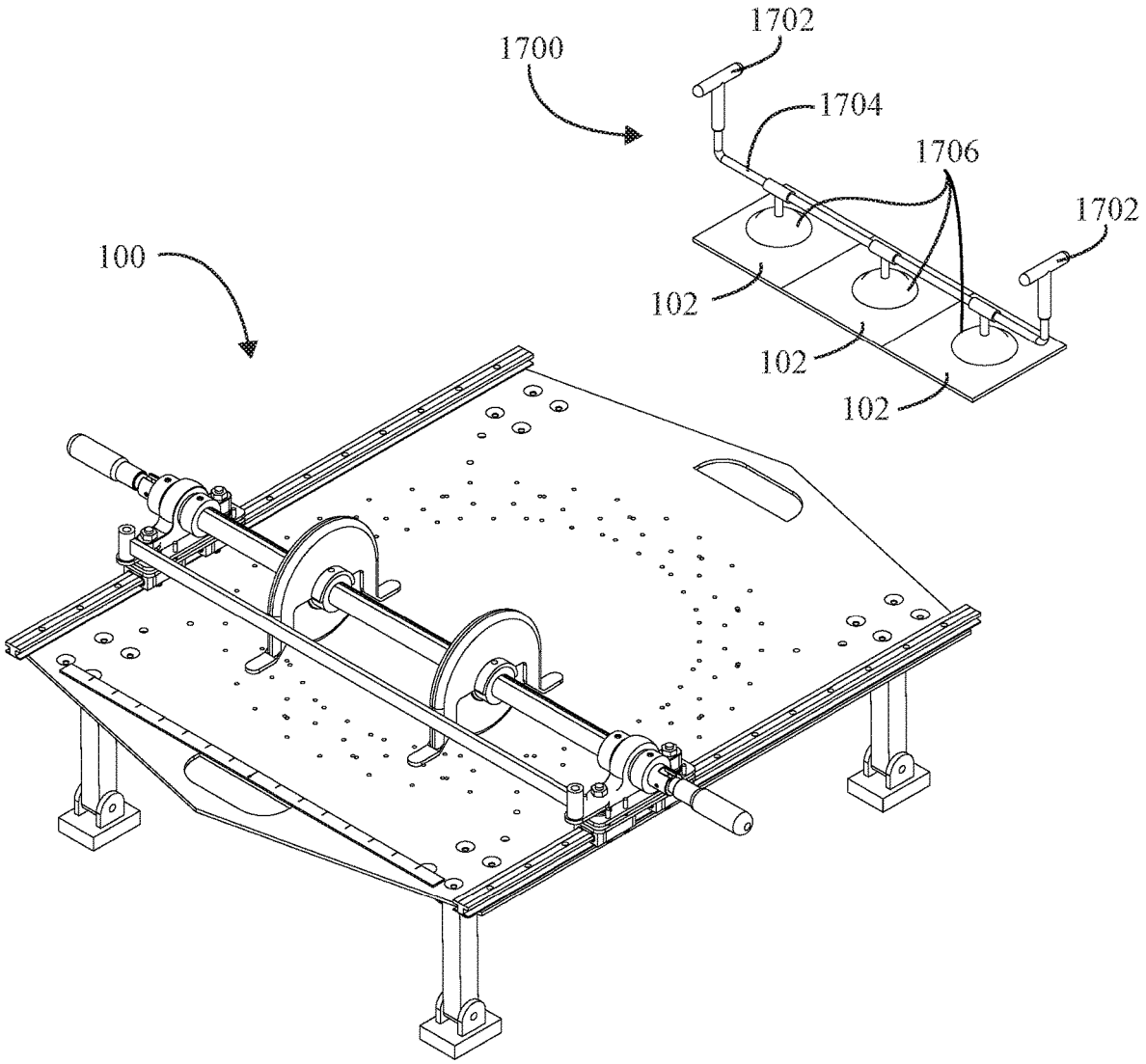
FIG. 17 is an orthographic view of the tile cutting device of FIG. 1 used in conjunction with a hot tile remover.

FIG. 17 is an orthographic view of the example tile cutting device used in conjunction with a hot tile remover 1700. Hot tile remover 1700 comprises a frame 1704 supported by a pair of handles 1702. Hot tile remover further comprises a plurality of suction cups 1706 which may each be independently positioned along frame 1704. Hot tile remover 1700 is depicted supporting three tiles 102 recently cut by cutting device 100.

Figure 18:
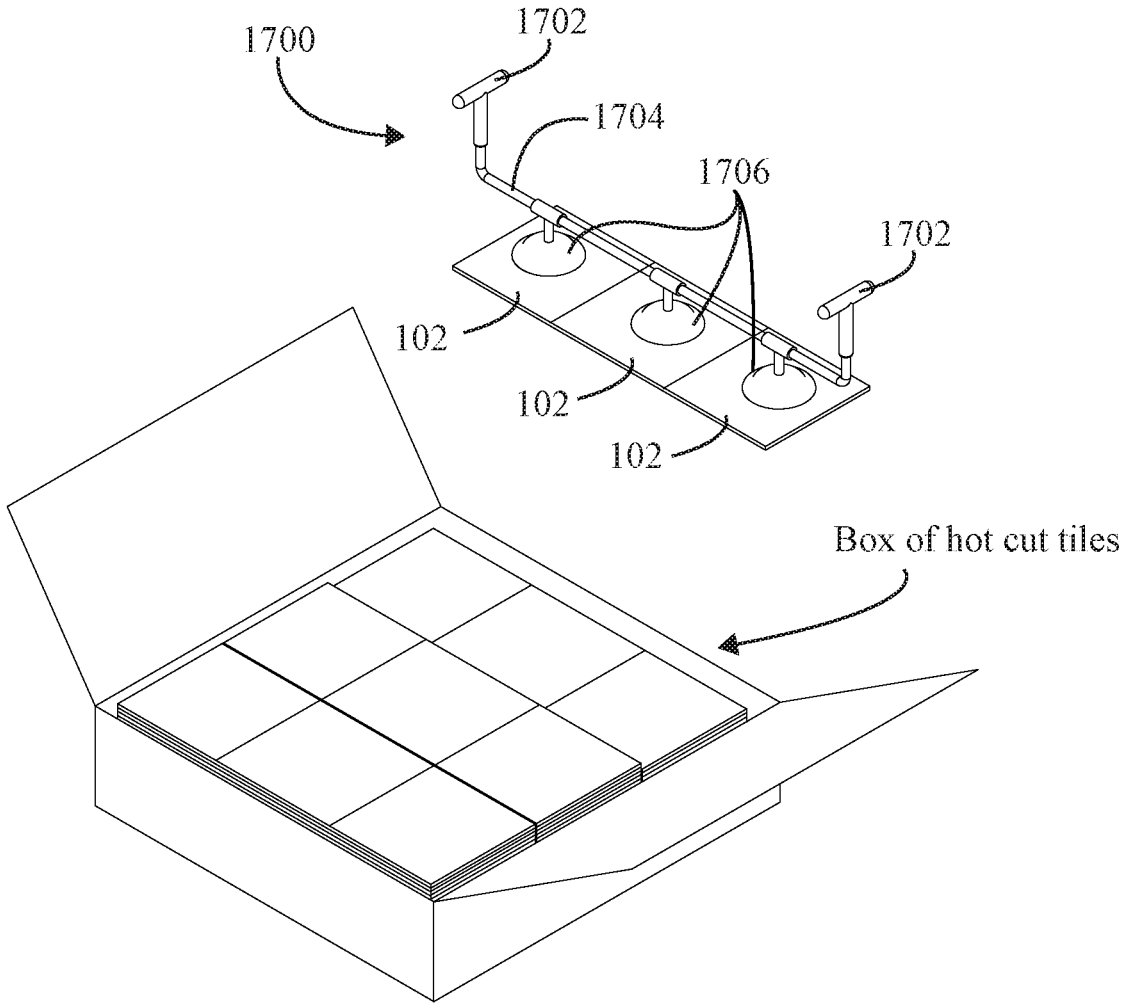
FIG. 18 is an environmental view of a box of cut tiles used in conjunction with the hot tile remover.

FIG. 18 is an environmental view of a box of cut tiles 102 used in conjunction with hot tile remover 1700.

While the devices, systems, methods, and so on have been illustrated by describing examples, and while the examples have been described in considerable detail, it is not the intention of the applicant to restrict, or in any way, limit the scope of the appended claims to such detail. It is, of course, not possible to describe every conceivable combination of components or methodologies for purposes of describing the devices, systems, methods, and so on provided herein. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's general inventive concept. Thus, this application is intended to embrace alterations, modifications, and variations that fall within the scope of the appended claims. The preceding description is not meant to limit the scope of the invention. Rather, the scope of the invention is to be determined by the appended claims and their equivalents.

Finally, to the extent that the term "includes" or "including" is employed in the detailed description or the claims, it is intended to be inclusive in a manner similar to the term "comprising," as that term is interpreted when employed as a transitional word in a claim. Furthermore, to the extent that the term "or" is employed in the claims (e.g., A or B) it is intended to mean "A or B or both." When the applicants intend to indicate "only A or B, but not both," then the term "only A or B but not both" will be employed. Similarly, when the applicants intend to indicate "one and only one" of A, B, or C, the applicants will employ the phrase "one and only one." Thus, use of the term "or" herein is the inclusive, and not the exclusive use. See Bryan A. Garner, A Dictionary of Modern Legal Usage 624 (2*d*. Ed. 1995).

What is claimed is:

1. A vinyl tile cutting device configured to cut vinyl tiles into a plurality of different shapes, said vinyl tile cutting device comprising:

a base element, said base element being conductive and configured to support a vinyl tile thereon during a cutting process, said vinyl tile having at least one cutting path;

a cutting assembly disposed above said base element, said cutting assembly including a plurality of non-motorized, toothless, rotatable cutting blades for cutting said vinyl tile in a generally linear path along a longitudinal extension of said base element, each cutting blade defining an axis of rotation, and each cutting blade is disposed spaced-apart from at least one other cutting blade in the direction of the axis of rotation; and a heating element disposed beneath said base element and substantially spanning the longitudinal extension of said base element beneath the path of said cutting assembly, said heating element configured to adjustably and simultaneously heat all cutting paths of said vinyl tile prior to and contemporaneous with the cutting of said vinyl tile;

wherein said vinyl tile cutting device is configured to accurately cut said vinyl tile at a plurality of predetermined cutting angles relative to one or more edges of said vinyl tile.

2. The vinyl tile cutting device according to claim 1, wherein said base element comprises a cutting plate for supporting said tile thereon, said cutting plate comprising indicia for aligning said vinyl tile in a plurality of different angular positions so that said tile is capable of being cut at said plurality of predetermined cutting angles.

3. The vinyl tile cutting device according to claim 1, wherein said base element comprises a pair of spaced-apart rails for supporting said cutting assembly.

4. The vinyl tile cutting device according to claim 1, wherein said cutting assembly further includes a safety cover disposed over at least a portion of said plurality of spaced-apart rotatable cutting blades so as to protect a user of said vinyl tile cutting device from being inadvertently cut by said plurality of spaced-apart rotatable cutting blades.

5. The vinyl tile cutting device according to claim 1, wherein said base element includes one or more securing elements for holding said vinyl tile in place relative to said base element.

6. The vinyl tile cutting device according to claim 1, wherein said base element includes a top surface and a bottom surface, said top surface of said base element configured to support said tile thereon, and said bottom surface of said base element supported on a plurality of support legs.

7. The vinyl tile cutting device according to claim 1, wherein said plurality of predetermined cutting angles relative to said one or more edges of said vinyl tile at least include: (i) a ninety degree cutting angle, (ii) a forty-five degree cutting angle, and (iii) a twenty-two and one-half degree cutting angle.

8. A vinyl tile cutting device configured to cut vinyl tiles into a plurality of different shapes, said vinyl tile cutting device comprising:

a base element, said base element being conductive and configured to support a vinyl tile thereon, said vinyl tile having a cutting path;

a cutting assembly disposed above said base element, said cutting assembly including a plurality of non-motorized, rotating cutting blades for cutting said vinyl tile in a generally linear path along a longitudinal extension of said base element, each cutting blade defining an axis of rotation, and each cutting blade is disposed spaced-apart from at least one other cutting blade in the direction of the axis of rotation; and a heating element disposed beneath said base element and substantially spanning the longitudinal extension of said base element beneath the path of said cutting assembly, said heating element configured to adjustably and simultaneously heat the entire cutting path of said vinyl tile prior to and contemporaneous with the cutting of said vinyl tile;

wherein said vinyl tile cutting device is configured to accurately cut said vinyl tile at a plurality of predetermined cutting angles relative to one or more edges of said tile.

9. The vinyl tile cutting device according to claim 8, wherein said base element comprises a cutting plate for supporting said tile thereon, said cutting plate comprising indicia for aligning said tile in a plurality of different angular positions so that said vinyl tile is capable of being cut at said plurality of predetermined cutting angles.

10. The vinyl tile cutting device according to claim 8, wherein said cutting assembly further includes a safety cover disposed over at least a portion of said plurality of rotatable cutting blades so as to protect a user of said vinyl tile cutting device from being inadvertently cut by said plurality of rotatable cutting blades.

11. The vinyl tile cutting device according to claim 8, wherein said base element includes one or more securing mechanisms for holding said vinyl tile in place relative to said base element.

12. The vinyl tile cutting device according to claim 8, wherein said base element includes a top surface and a bottom surface, said top surface of said base element configured to support said tile thereon, and said bottom surface of said base element supported on a plurality of support legs.

13. The vinyl tile cutting device according to claim 8, wherein said plurality of predetermined cutting angles relative to said one or more edges of said vinyl tile at least include: (i) a ninety degree cutting angle, (ii) a forty-five degree cutting angle, and (iii) a twenty-two and one-half degree cutting angle.

* * * * *